US005229784A

United States Patent [19]

Jones

[11] Patent Number: 5,229,784

[45] Date of Patent: Jul. 20, 1993

[54] ANTENNA MOUNT

[75] Inventor: George R. Jones, Grand Prairie, Tex.

[73] Assignee: Firstech Industries, Inc., Grand Prairie, Tex.

[21] Appl. No.: 819,617

[22] Filed: Jan. 9, 1992

Related U.S. Application Data

[63] Continuation of Ser. No. 635,386, Jan. 7, 1991, abandoned, which is a continuation of Ser. No. 401,816, Sep. 1, 1989, abandoned.

[51] Int. Cl.[5] ..... H01Q 1/12

[52] U.S. Cl. ..... 343/888; 343/878; 343/906

[58] Field of Search ..... 343/888, 900, 715, 882, 343/880, 814, 878, 906; 403/229, 223, 220, 291; 439/916

[56] References Cited

U.S. PATENT DOCUMENTS

| | | | |
|---|---|---|---|
| 839,260 | 12/1906 | Benson | 403/229 |
| 2,493,787 | 1/1950 | Torretti | 343/900 |
| 2,558,763 | 7/1951 | Lee . | |
| 2,688,187 | 2/1954 | Von Wald, Jr. et al. . | |
| 3,249,945 | 5/1966 | Lewis | 343/749 |
| 3,474,453 | 10/1969 | Ireland | 343/750 |
| 3,928,952 | 12/1975 | Whyte | 343/888 |
| 4,255,735 | 3/1981 | Liautaud | 343/715 |
| 4,360,814 | 11/1982 | Wells | 343/715 |
| 4,540,989 | 9/1985 | Day, Jr. | 343/900 |
| 4,625,213 | 11/1986 | Horn | 343/715 |
| 4,882,591 | 11/1989 | Galvin et al. | 343/888 |
| 4,914,450 | 4/1990 | Dilley et al. | 343/715 |
| 4,931,807 | 6/1990 | Naitou | 343/745 |

*Primary Examiner*—Rolf Hille
*Assistant Examiner*—Hoanganh Le
*Attorney, Agent, or Firm*—Charles D. Gunter, Jr.

[57] ABSTRACT

An antenna mount is shown for mounting an antenna whip on a support surface. The mount includes a first adapter for receiving and coupling the antenna whip to the mount and a second adapter for receiving and coupling the lead-in conductor to the mount. A coil spring is located intermediate and serves as the electrical connection between the first and second adapters. A one-piece elastomeric body is molded about the spring with the adapters being exposed for connection to the antenna whip and lead-in conductor.

6 Claims, 1 Drawing Sheet

ANTENNA MOUNT

This application is a continuation of application Ser. No. 07/635,386, filed Jan. 7, 1991, now abandoned, which is a continuation of application Ser. No. 401,816, filed Sep. 1, 1989, now abandoned.

BACKGROUND OF THE INVENTION

1. Field of the Invention

The present invention relates to antennas of the type used in mobile radio communications and, specifically, to an improved mount for such an antenna.

2. Description of the Prior Art

A variety of antenna configurations are known which utilize flexible members as mounts for mounting the antenna mast upon a support surface. For instance, such mounts are widely used on automobiles, water craft and other motor vehicles. Typical mobile radio communication antennas of the type utilized on automotive vehicles employ "whip" antennas which consist of long conductive rods often made of metal. Whip antennas are conventionally mounted on the support surface of a vehicle by a mount which consists of a base affixed to the vehicle and an external, metal spring in which the lower end of the whip is fastened. The lower end of the external spring is connected to the base and a flexible conductor, usually insulated, is located within the external spring. The flexible conductor extends between the lower end of the antenna whip and means on the base for coupling the conductor to the lead-in cable by which the antenna is connected to the radio set within the vehicle.

In the past, the external, metal spring has consisted of heavy wire wound so as to bulge between its ends. The purpose of the external spring was to permit the antenna rod to fold downwardly at the mount when the upper portion of the rod struck an overhead obstruction which would otherwise bend or break the rod.

Although the external, metal spring has been widely used in whip antennas of the past, certain problems have arisen due to noise generation, particularly where radio frequencies were simultaneously transmitted and received. The external, metal spring was also subject to corrosion and to metal fatigue in use.

As a result, there have been several attempts in the prior art to provide a molded elastomeric body which serves the necessary mechanical functions of allowing the whip to flex while at the same time reducing the DC static associated with the flexing of the external, metal spring. U.S. Pat. No. 2,558,763, to Lee, issued Jul. 3, 1951, shows an antenna mount having a flexible base which includes a plurality of vertically extending spring wires as well as helical spring windings. U.S. Pat. No. 2,668,187, to Von Wald, Jr. et al, issued Feb. 2, 1954, shows a communications antenna with a lead through insulator and a polyethylene sheath. U.S. Pat. No. 4,625,213, to Horn, issued Nov. 25, 1986, shows an antenna mount with a fitting adapted to receive the antenna whip and an opposite fitting adapted to receive a lead-in connector, the fittings being supported by a body formed from a flexible elastomer which provides the sole restoring force to return the whip from the deflected to the upright position.

The present invention has as its object to provide an improved antenna mount which reduces the noise generation created by the flexing of an external, metal wire spring of the type used in prior art whip antennas.

Another object of the invention is to provide an antenna mount having an internal construction capable of providing the restoring force to return the antenna whip from the deflected to the upright position.

Another object of the invention is to provide an antenna mount having an internal construction which eliminates the need for an internal grounding strap of the type used to connect the antenna whip and the lead-in conductor.

Another object of the invention is to provide an antenna mount formed principally from a flexible elastomer to provide improved insulating properties.

Another object of the invention is to provide an antenna mount which is simple in design and economical to manufacture and which is extremely durable in use.

Additional objects, features and advantages will be apparent in the written description which follows.

SUMMARY OF THE INVENTION

The antenna mount of the invention is used to deflectably mount an antenna whip onto a supporting surface and to couple the antenna whip to a lead-in conductor. The mount includes a first adapter for receiving and coupling the antenna whip to the mount and an oppositely arranged, second adapter for receiving and coupling the lead-in conductor to the mount. An internal coil spring is located intermediate and connects the first and second adapter. A one-piece elastomeric body is molded about the coil spring, the elastomeric body having first and second ends which support the first and second adapters, whereby the first and second adapters can be accessed for coupling to the antenna whip and the lead-in conductor, respectively.

Preferably, the internal coil spring is a helically wound member having an open interior and cylindrical end openings. The first and second adapters each have an outer extent and a cylindrical inner extent which is received within the cylindrical end openings of the coil spring by press-fitting the cylindrical end openings into the coil spring.

DETAILED DESCRIPTION OF THE INVENTION

Figure 1:
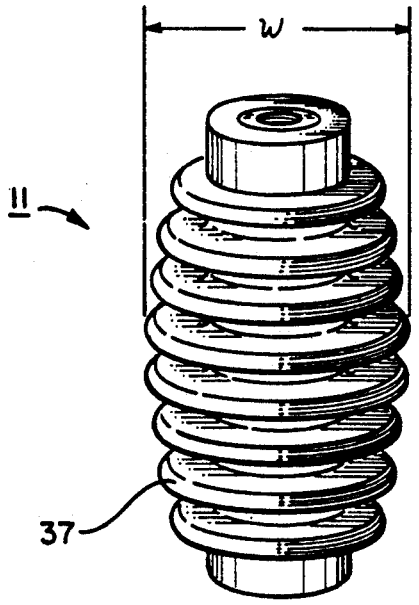
FIG. 1 is a side, perspective view of the antenna mount of the invention.

FIG. 1 shows an antenna mount of the invention, designated generally as 11, which is well suited for low band applications. The antenna mount 11 is particularly suited for deflectably mounting an antenna whip (not shown) onto a supporting surface, such as the external hood region of a vehicle. Whips of the above type are well known in the art and are shown, for instance, in U.S. Pat. No. 4,625,213 and U.S. Pat. No. 2,558,763, the disclosure of which is hereby incorporated by reference.

Figure 2:
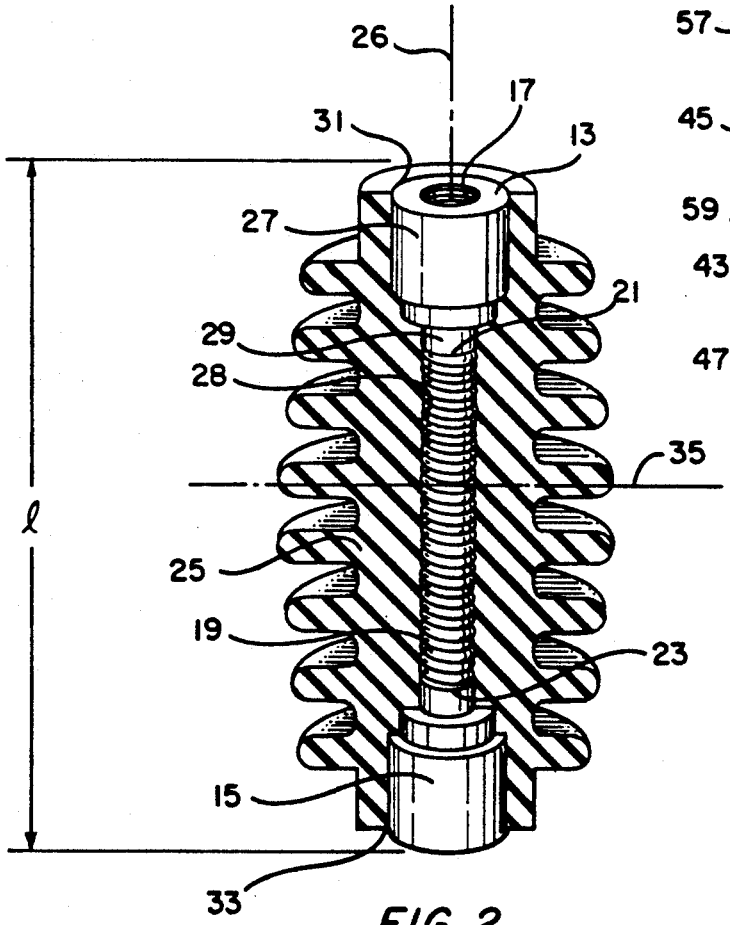
FIG. 2 is a side view, similar to FIG. 1, but with portions of the elastomeric body broken away to reveal the coil spring utilized in the antenna mount.

The antenna mount 11, as shown in FIG. 2, includes a first adapter 13 for receiving and coupling the antenna whip to the mount. This is conveniently accomplished by providing the first adapter 13 with an externally accessible threaded bore 17. The antenna whip can be provided with an externally threaded lower end adapted to mate with the threaded bore 17. An oppositely arranged second adapter 15 is provided for receiving and coupling the antenna lead-in conductor to the mount. The second adapter 15 is internally threaded in the same manner as the threaded bore 17 of the first adapter for receiving a conventional coupler (not shown) which electrically couples the lead-in cable to the radio set within the vehicle to the second adapter 15. The conventional coupler may also mechanically connect or aid in the connection of the antenna mount to the support surface of the vehicle, whereby the mount is affixed to the vehicle at a suitable location. Such a location can include the roof, body, mirror mount, or bumper of the vehicle.

An internal coil spring 19 is located intermediate and connects the first and second adapters 13, 15 within the mount 11. The internal spring 19 is a helically wound member having an open interior and cylindrical end openings 21, 23. Springs of the above type are familiar to those skilled in the spring arts as "closely wound extension springs" having closed and ground ends. The internal spring 19 is centrally located within the mount body 25, the body 25 being molded about the spring with the spring arranged parallel to the longitudinal axis 26 of the body 25 within an internal bore 28.

The spring can be designed with a predetermined spring tension characteristic which essentially provides the sole restoring force to return the elastomeric body from the deflected position to the relaxed position. By "spring tension characteristic" is meant the selection of a spring having the requisite wire diameter, number of coils and mean coil diameter to withstand the design bending stress for a particular application. For example, assume:

d=Wire Diameter in inches
M=Moment or Torque in in-lbs
E=Modulus of Elasticity
S=Bending Stress
N=Number of coils
D=Mean coil Diameter
T=Angular Deflection of the spring For the particular application, the Maximum Weight the spring has to support=30 lbs.

The antenna mount is to be 3 inches long and is to be deflected through a 120 degree angle. The horizontal displacement on one side will be 5.2 inches. The torque $M=30\times5.2=156$ in-lbs. Assuming a minimum tensile strength of 250,000 psi for the wire, the design bending stress $S=0.75\times250{,}000=187{,}500$ psi. The diameter of the wire can be calculated by the following equation:

$$d=\frac{32\times M}{11\times S}=\frac{32\times 156}{11\times 1875000}=.175 \text{ inches}$$

$$T=120/360=.333$$
$$\text{Mean diameter } D=.500$$

Number of coils N can be calculated by the following equation:

$$N=\frac{E\times d\times t}{10.8\times D\times M}=\frac{30\times 10\times .175\times .333}{10.8\times .5\times 156}=11.22 \text{ turns}$$

Each of the first and second adapters 13, 15 has a generally cylindrical outer extent 27, and a generally cylindrical, stepped inner extent 29 which is sized to be received within the cylindrical end openings 21, 23 of the coil spring 19 in press-fit fashion. As shown in FIG. 2, the adapters can have a plurality of steps between the inner and outer extents thereof. The threaded bores 17 do not extend completely through the adapters 13, 15 so that the open interior of the internal spring 19 is closed off when the adapters are installed. The coils of the spring 19 can be uninsulated and touch one another when the internal spring is in the relaxed state shown in FIG. 2.

The mount body 25 is preferably molded about the first adapter 13, second adapter 15 and internal spring 19 as by injection molding, the internal components being placed in a mold cavity with the elastomer being injected under appropriate temperature and pressure conditions. The body has end openings 31, 33 through which the first and second adapters 13, 15 are exposed, whereby the first and second adapters can be accessed for coupling to the antenna whip and lead-in conductor, respectively.

The elastomer selected for the body 25 can be any flexible elastomer capable of being bent through a 90° angle about the axis 35 drawn to bisect the length "1" of the body 25. Preferably, the elastomer is an EPDM rubber which has a durometer hardness in the range from about 30–70 most preferably 60–70, and which is capable of bonding securely to the metal of the adapters 13, 15 and internal spring 19. The rubber should be selected to withstand at least about 50,000 cycles of 30° bending without cracking.

The body 25 has an exterior defined by the length "1" and the width "w" which is provided with a plurality of flutes 37, the flutes being of diminishing width on either side of the axis 35 so that the mount has a "bell-shape" which generally bulges in the mid region of the mount.

The length and proportions of the molded body 25 and arrangement of the flutes 37 are determined by the flexibility of the compounded elastomer used for the body. Preferably, the body is provided with sufficient flexibility, when the antenna whip is struck or otherwise deflected, to allow the body 25 to fold between the adapters 13, 15 about the axis 35 from the vertical, relaxed position to a 90° deflected position without damage to the whip. The flexibility should also allow the whip to bend approximately 90° from the vertical in any direction when the base of the mount is horizontal and yet have sufficient stiffness to maintain the antenna whip vertical under normally encountered wind-loads.

The internal spring 19 provides the sole electrical connection between the first and second adapters 13, 15, and thus between the antenna whip and the lead-in conductor passing to the interior of the vehicle. As such, the need for a grounding strap to connect the adapters 13, 15 is eliminated. The internal spring 19 also serves the purpose of providing the restoring force for returning the mount from the deflected position to the relaxed position shown in FIGS. 1 and 2.

Figure 3:
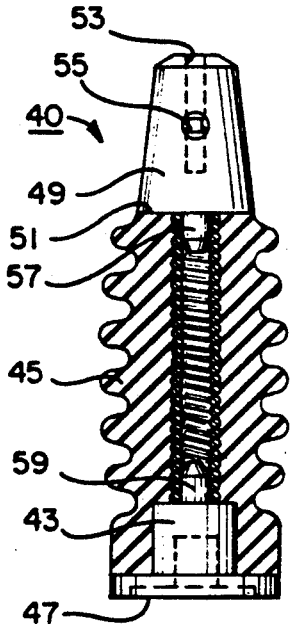
FIG. 3 is a side view of another embodiment of the antenna mount of the invention, with portions broken away for ease of illustration.

FIG. 3 shows another embodiment of the antenna mount of the invention for high band applications, designated as 40. In the embodiment shown in FIG. 3, the second adapter 43 is surrounded by the elastomeric body 45 with the exception of the adapter end 47 which exposes the second adapter for receiving and coupling the lead-in conductor to the mount 40. A conically tapered first adapter 49 rests upon the end surface 51 of the elastomeric body 45 so as to be accessible for receiving the antenna whip. An internal bore 53 and set screw 55 are used for mounting the antenna whip. Each of the first and second adapters has a tapered inner extent 57, 59 which is press-fit within the cylindrical end openings of the internal spring.

An invention has been provided with several advantages. The antenna mount of the invention is simple in design and economical to manufacture. The elastomeric body is extremely durable under normal operating conditions. The mount is extremely sturdy and, due to its insulated nature, reduces noise generation typical of the prior art spring mounts. The internal coil spring located within the elastomeric body provides the restoring force for returning the deflected mount to the vertical position if the whip is struck or otherwise deflected. The coil spring also provides the electrical connection between the adapters used to join the whip to the lead-in conductor.

While the invention has been shown in only one of its forms, it is not thus limited but is susceptible to various changes and modifications without departing from the spirit thereof.

I claim:

1. An antenna mount for deflectably mounting an antenna whip onto a supporting surface and for coupling the antenna whip to a lead-in conductor, the mount comprising:

a first adapter for receiving and coupling the antenna whip to the mount;

an oppositely arranged, second adapter for receiving and coupling the lead-in conductor to the mount;

an internal, coil spring located intermediate and connecting the first and second adapters, the spring being a closely wound extension spring having a length and uninsulated coils which touch in the relaxed state to thereby provide electrical connection between the first and second adapters;

a one-piece elastomeric body molded about the coil spring and at least the said second adapter, the elastomeric body having an interior bore which terminates in an end opening through which the second adapter is exposed, the first adapter being accessible at an opposite end of the one-piece elastomeric body, the interior bore of the one-piece elastomeric body having internal sidewalls which are molded about and contact the internal coil spring along the entire length thereof, the one-piece elastomeric body having a radial thickness at least equal to the cross-sectional diameter of the interior bore, the elastomeric body being deflectable about an axis drawn to bisect the length of the elastomeric body between an initially relaxed position and a deflected position, the elastomeric body being returnable from the deflected position to the relaxed position by the application of a sufficient restoring force, the coil spring having a predetermined spring tension characteristic for providing the restoring force needed to return the body form the deflected position to the relaxed position, the internal coil spring comprising a single member located between the first and second adapters within the interior bore of the one-piece elastomeric body serving the dual purpose of providing the electrical connection between the first and second adapters while simultaneously providing the restoring force needed to return the body form the deflected position to the relaxed position.

2. The antenna mount of claim 1, wherein the coil spring is comprised of helically wound coils, the coil spring having an open interior and cylindrical end openings.

3. The antenna mount of claim 2, wherein the first and second adapters each have an outer extent and a generally cylindrical inner extent which is received within the cylindrical end openings of the coil spring.

4. The antenna mount of claim 3, wherein the first and second adapters are press-fit into the cylindrical end openings of the coil spring.

5. The antenna mount of claim 1, wherein the elastomeric body has an exterior defined by a width and a length, the exterior being provided with a plurality of flutes, the flutes being of diminishing width on either side of an axis drawn to bisect the length of the body.

6. An antenna mount for deflectably mounting an antenna whip onto a supporting surface and for coupling the antenna whip to a lead-in conductor, the mount comprising:

an internally threaded, first adapter for receiving and coupling the antenna whip to the mount;

an oppositely arranged, internally threaded second adapter for receiving and coupling the lead-in conductor to the mount;

an internal, coil spring located intermediate and connecting the first and second adapters, the spring being a closely wound extension spring having a length and uninsulated coils which touch in the relaxed state to thereby provide electrical connection between the first and second adapters;

a one-piece elastomeric body molded about the first adapter, coil spring and second adapter, the elastomeric body having first and second ends provided with end openings through which the first and second adapters are exposed, the interior bore of the one-piece elastomeric body having internal sidewalls which are molded about and contact the internal coil spring along the entire length thereof, the one-piece elastomeric body having a solid radial thickness at least equal to the cross-sectional diameter of the interior bore, the elastomeric body being deflectable about an axis drawn to bisect the length of the elastomeric body between an initially relaxed position and a deflected position, the elastomeric body being returnable from the deflected position to the relaxed position by the application of a sufficient restoring force, the coil spring having a predetermined spring tension characteristic for providing the restoring force needed to return the body form the deflected position to the relaxed position, the internal coil spring comprising a single member located between the first and second adapters within the interior bore of the one-piece elastomeric body serving the dual purpose of providing the electrical connection between the first and second adapters while simultaneously providing the restoring force needed to return the body from the deflected position to the relaxed position; and wherein the elastomeric body has an exterior defined by a width and a length, the exterior being provided with a plurality of flutes which extend outwardly form the solid radial thickness of the elastomeric body.

* * * * *